US007445277B2

(12) United States Patent
Voris

(10) Patent No.: US 7,445,277 B2
(45) Date of Patent: Nov. 4, 2008

(54) FOLDABLE CHAIR WITH EXTENSIBLE LEGS

(75) Inventor: Larry Voris, Nashville, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 11/842,750

(22) Filed: Aug. 21, 2007

(65) Prior Publication Data

US 2008/0084094 A1 Apr. 10, 2008

Related U.S. Application Data

(60) Provisional application No. 60/823,227, filed on Aug. 22, 2006.

(51) Int. Cl.
*A47C 4/20* (2006.01)

(52) U.S. Cl. ..... 297/58

(58) Field of Classification Search ..... 297/16.1, 297/58

See application file for complete search history.

(56) References Cited

U.S. PATENT DOCUMENTS

| | | | | |
|---|---|---|---|---|
| 1,789,295 | A | 1/1931 | Bauer | |
| 1,919,746 | A * | 7/1933 | Rastetter | 297/58 |
| 2,178,195 | A * | 10/1939 | Witman | 297/58 |
| 2,255,870 | A * | 9/1941 | Adler | 297/58 |
| 2,270,562 | A * | 1/1942 | Schermerhorn | 297/58 |
| 2,360,400 | A * | 10/1944 | Clarin | 297/58 |
| 2,692,011 | A | 10/1954 | Hickok | |
| 2,708,962 | A | 5/1955 | Rechler | |
| 2,757,715 | A | 8/1956 | Hendrickson | |
| 4,629,245 | A | 12/1986 | Hardarson | |
| 4,772,068 | A | 9/1988 | Gleckler et al. | |
| 5,577,799 | A | 11/1996 | St. Germain | |
| 5,634,684 | A | 6/1997 | Kojima et al. | |
| 5,707,104 | A * | 1/1998 | Perego | 297/16.1 |
| 5,718,474 | A | 2/1998 | Kojima et al. | |
| 6,095,597 | A | 8/2000 | Huang | |
| 6,279,991 | B1 | 8/2001 | Atkins et al. | |
| 6,332,646 | B1 | 12/2001 | Tseng | |
| 6,435,607 | B1 | 8/2002 | Liu | |
| 6,669,281 | B1 | 12/2003 | Huang | |
| 6,871,911 | B2 | 3/2005 | Alexander, Jr. | |
| 7,219,955 | B2 | 5/2007 | Lu et al. | |
| 2003/0234563 | A1 | 12/2003 | Huang | |
| 2004/0239153 | A1 | 12/2004 | Leng | |
| 2007/0164598 | A1 | 7/2007 | Lu et al. | |

* cited by examiner

*Primary Examiner*—Peter R. Brown
(74) *Attorney, Agent, or Firm*—Barnes & Thornburg LLP

(57) ABSTRACT

The present disclosure relates to a foldable chair having an expanded use configuration and a collapsed storage configuration. The foldable chair includes front and rear legs, a seat back coupled to the front legs, and a seat bottom mounted to pivot relative to the front and back legs.

6 Claims, 4 Drawing Sheets

FOLDABLE CHAIR WITH EXTENSIBLE LEGS

This application claims priority under 35 U.S.C. § 119(e) to U.S. Provisional Application Ser. No. 60/823,227, filed Aug. 22, 2006, which is expressly incorporated by reference herein.

BACKGROUND

The present disclosure relates to a foldable chair, and particularly to a foldable chair that has an expanded use configuration and a collapsed storage configuration. More particularly, the present disclosure relates to a foldable chair including front and rear legs, a seat back coupled to the front legs, and a seat mounted to pivot relative to the front and back legs.

SUMMARY

A foldable chair in accordance with the present disclosure includes a right-side frame, a foldable left-side frame, and a seat or seat bottom positioned to lie between the foldable right-side and left-side frames. Fold-control linkages or spacing-control means or linking means are provided to couple the front and rear legs to each other and to couple the seat to each of the right-side and left-side frames to allow movement of the legs relative to each other and movement of the seat relative to the frames between a generally horizontal extended position upon unfolding of the foldable chair to assume an expanded, use position and a generally vertical retracted position upon folding of the foldable chair to assume a collapsed, storage position.

In illustrative embodiments, the linking means are configured to establish at least a minimum leg clearance space between front and rear legs included in each of the right-side and left-side frames upon folding of the foldable chair to assume the collapsed, storage position. The spacing-control means are configured to maintain at least a minimum seat clearance space between the seat and each of the right-side and left-side frames during folding and unfolding of the foldable chair. In illustrative embodiments, each of the minimum seat and leg clearance spaces is greater than outer diameters or other similar external dimensions of the front and rear legs included in the right-side and left-side frames.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 4 is an enlarged side elevation view of the foldable chair of FIGS. 1 and 2 during folding movement of the seat in a "clockwise" direction during controlled collapse of the foldable chair and showing telescoping movement of an upper rear leg "rod" section relative to a companion lower leg "sleeve" section to lengthen the extensible rear leg to assume a "longer" second length;

FIG. 5 is a side elevation view similar to FIG. 3 showing continued folding movement of the seat in the clockwise direction and showing further lengthening of the extensible rear leg to assume an even longer third length;

FIG. 6 is a side elevation view similar to FIGS. 3 and 4 showing still more folding movement of the seat in the clockwise direction to cause the foldable chair to reach the collapsed, storage position and showing further lengthening of the extensible rear leg to assume a still longer fourth length and showing "leg" clearance spaces between the front legs included in the right-side and left-side frames and the rear legs included in the right-side and left-side frames;

DETAILED DESCRIPTION

Figure 1:
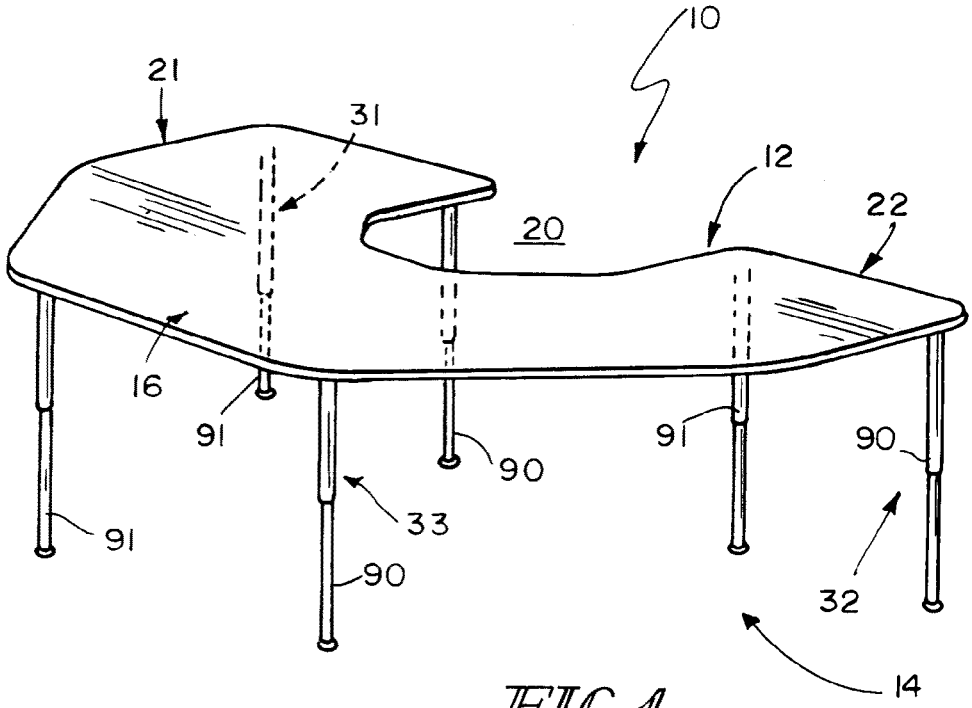
FIG. 1 is a first perspective view of a foldable chair in accordance with the present disclosure showing the chair in an expanded, use position and showing (in the foreground) one of the extensible rear legs included in the foldable chair.
Figure 2:
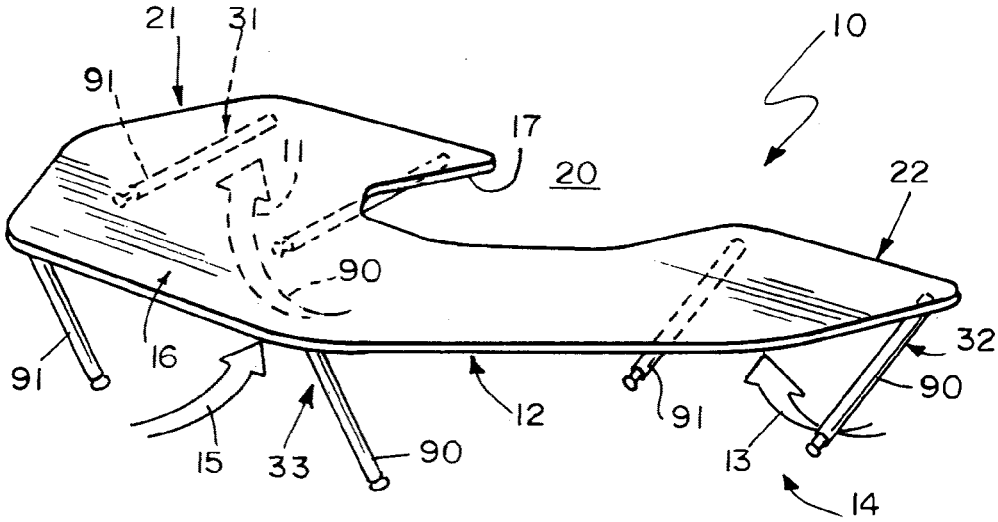
FIG. 2 is another perspective view of the foldable chair of FIG. 1 showing a seat back coupled to upper ends of the front legs and a seat supported between a right-side frame comprising companion front and rear legs and a left-side frame comprising companion front and rear legs.

A foldable chair 10 in accordance with the present disclosure includes a seat 12, a seat back 14, a right-side frame 16, and a left-side frame 18 as shown, for example, in FIGS. 1 and 2. Right-side frame 16 includes front and rear legs 161, 162 as shown, for example, in FIGS. 1 and 2. Left-side frame 18 includes front and rear legs 181, 182 as shown, for example, in FIGS. 1 and 2. Foldable chair 10 is configured to provide relatively wide clearance spaces between: (1) seat 12 and each of right-side and left-side frames 16, 18; (2) front and rear legs 161, 162; and (3) front and rear legs 181, 182 during folding and unfolding of foldable chair 10 as suggested in FIGS. 3-8.

Figure 6:
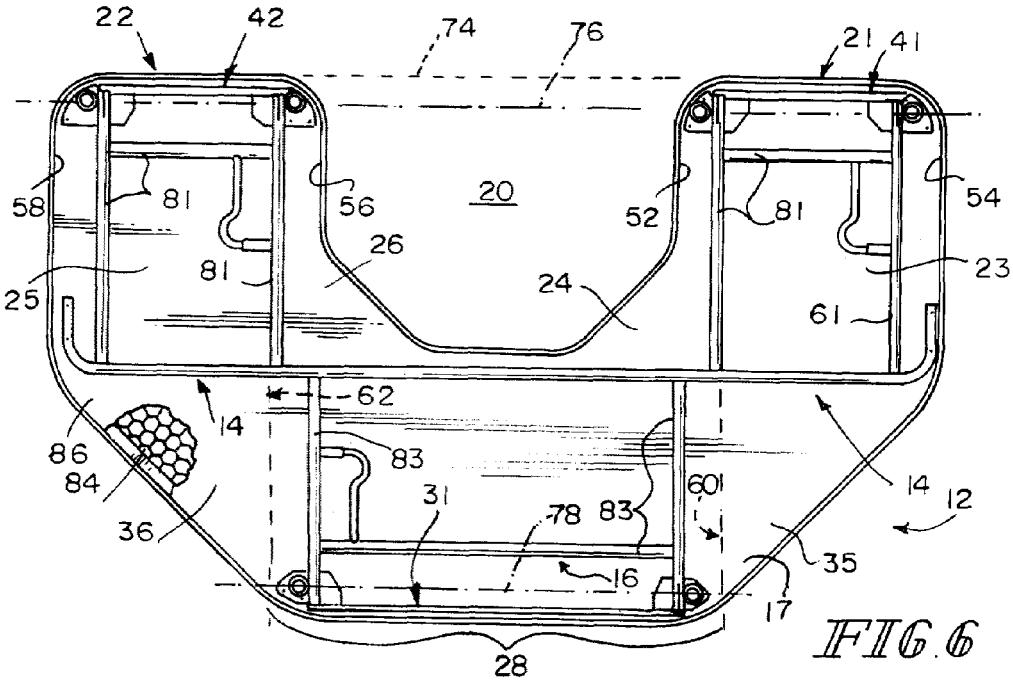
Figure 7:
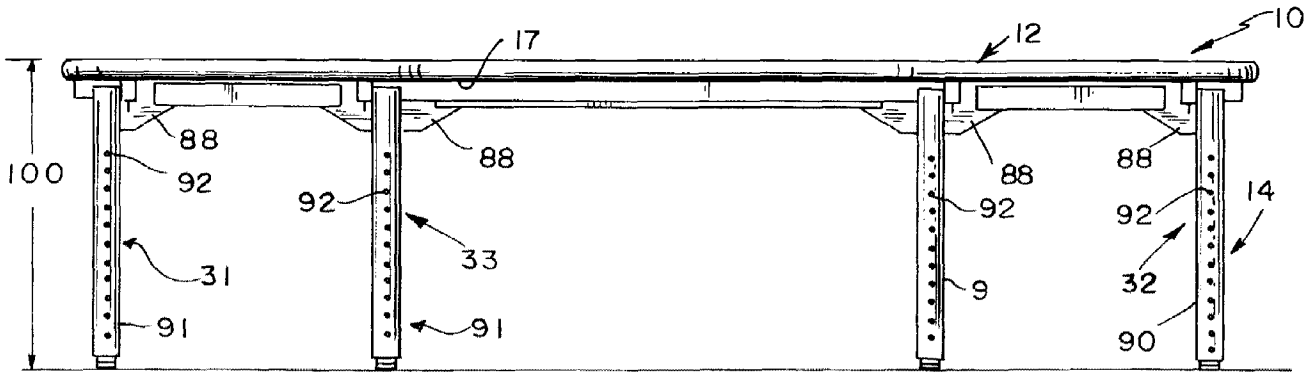
FIG. 7 is a side elevation similar to FIG. 6 but showing a "left" side of the collapsed chair rather than a "right" side of the collapsed chair as shown in FIG. 6.
Figure 8:
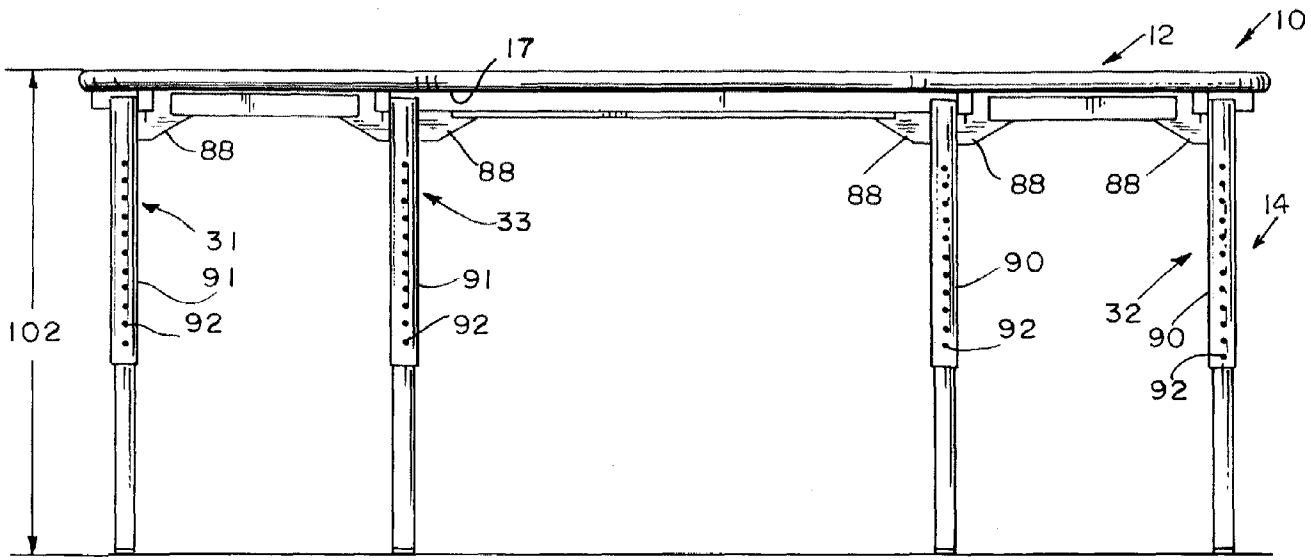
FIG. 8 is a front elevation view of the foldable chair of FIGS. 1-7 in the collapsed, storage position of FIGS. 6 and 7 showing "seat" clearance spaces provided between the seat and the front and rear legs included in the right-side frame and also between the seat and the front and rear legs included in the left-side frame.
Figure 1:
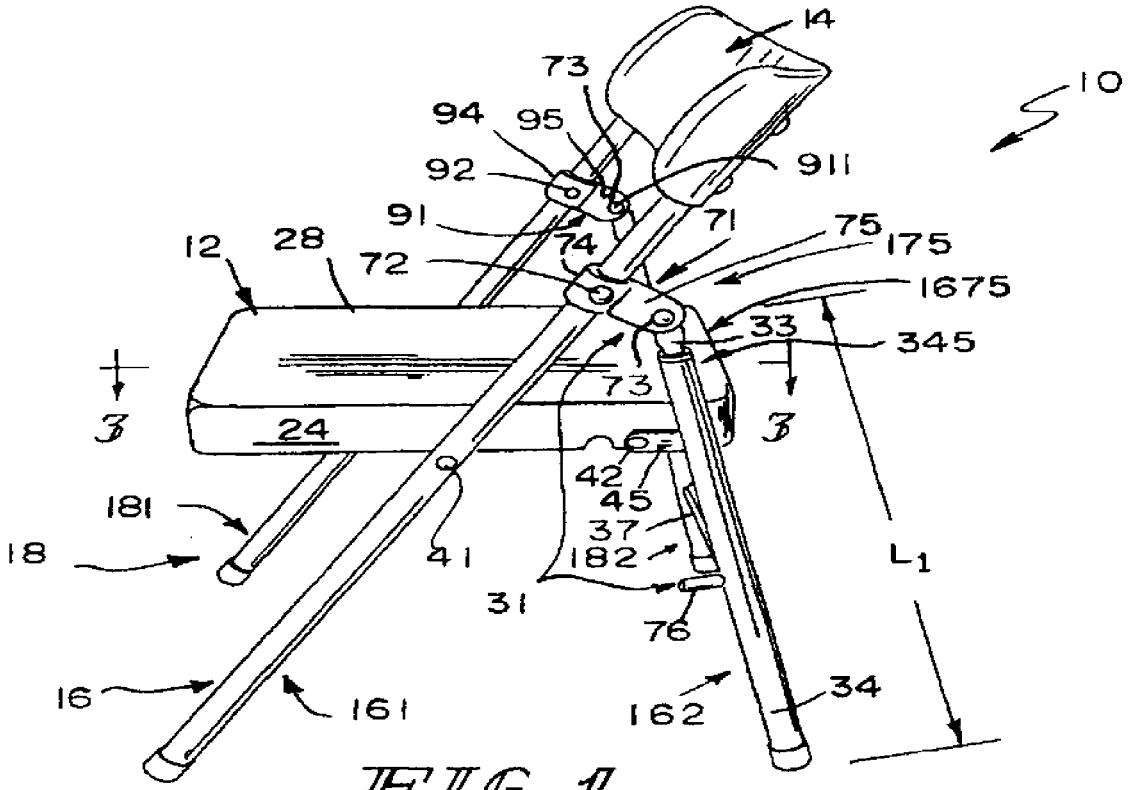
Figure 2:
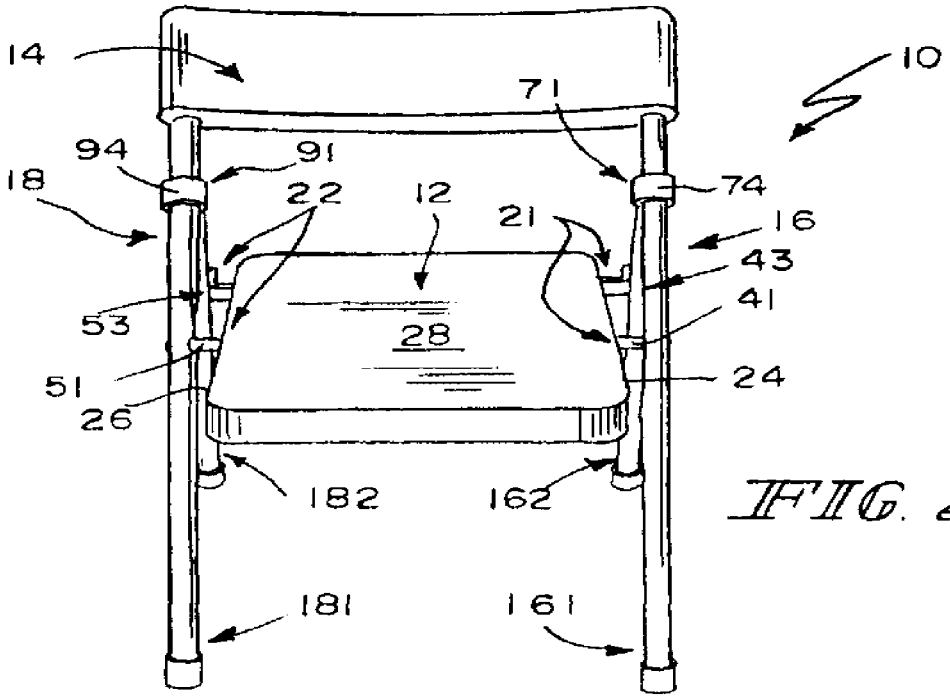
Figure 3:
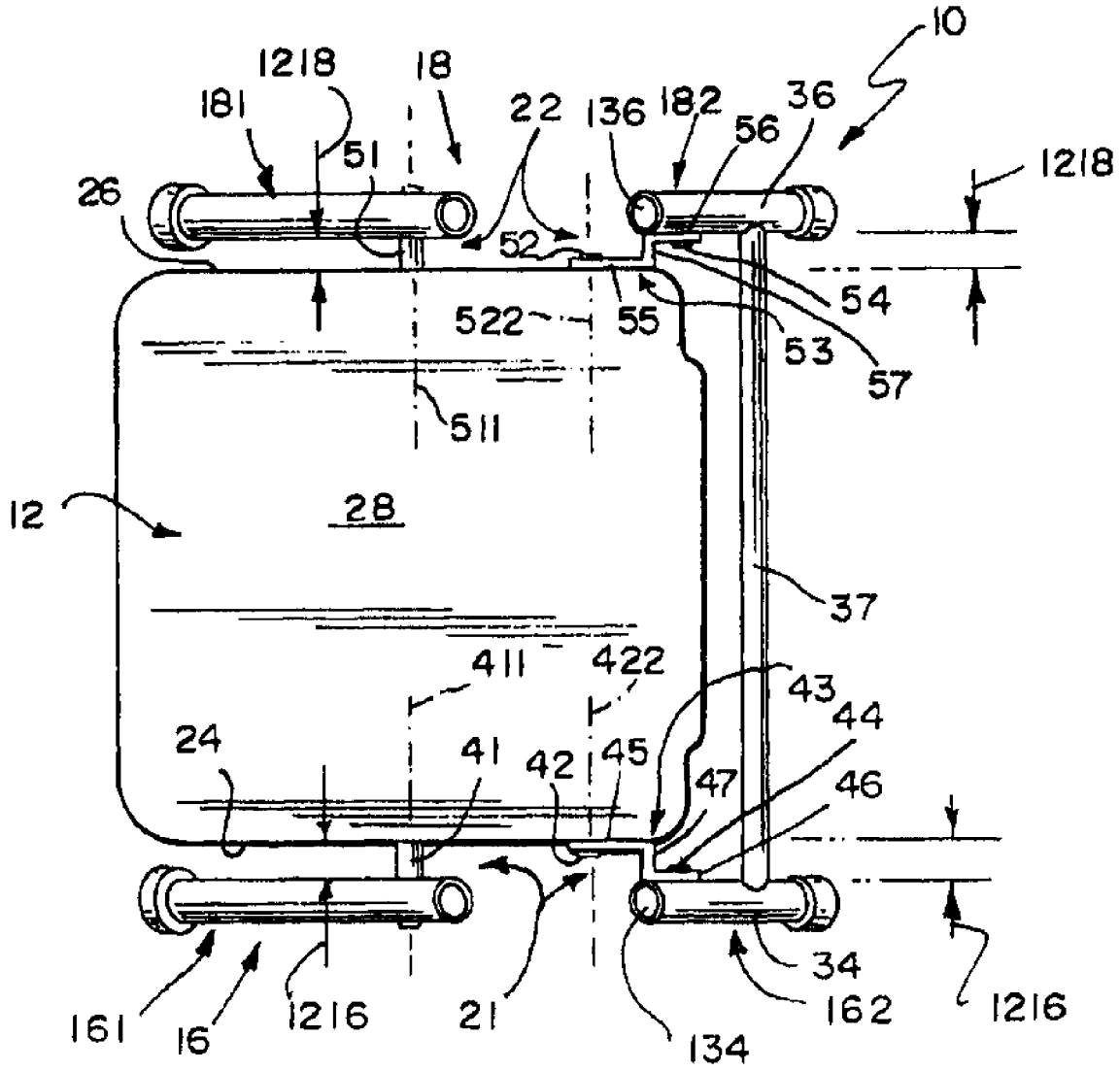
Figures 4, 5, 6, 7:
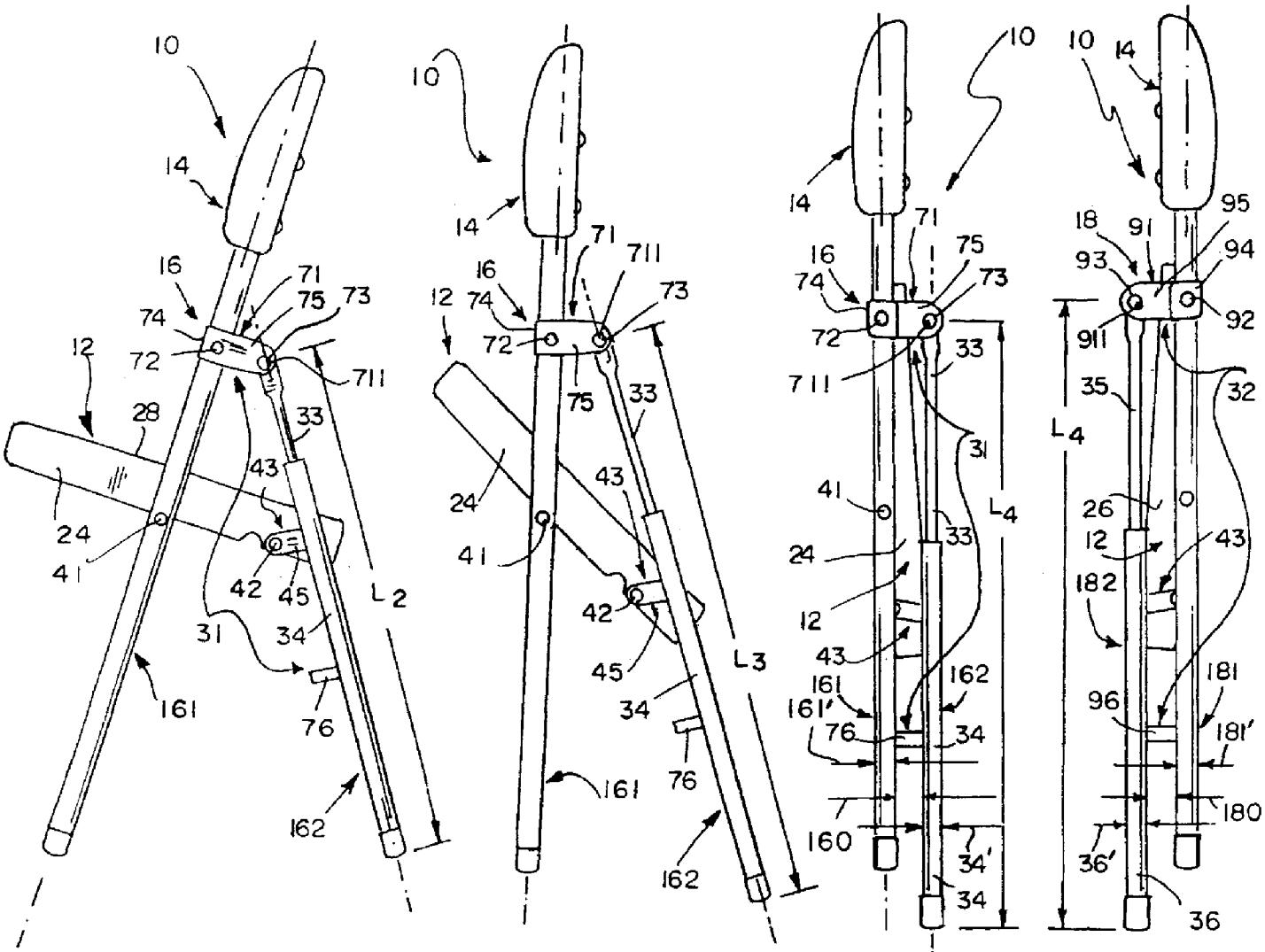
Figure 8:
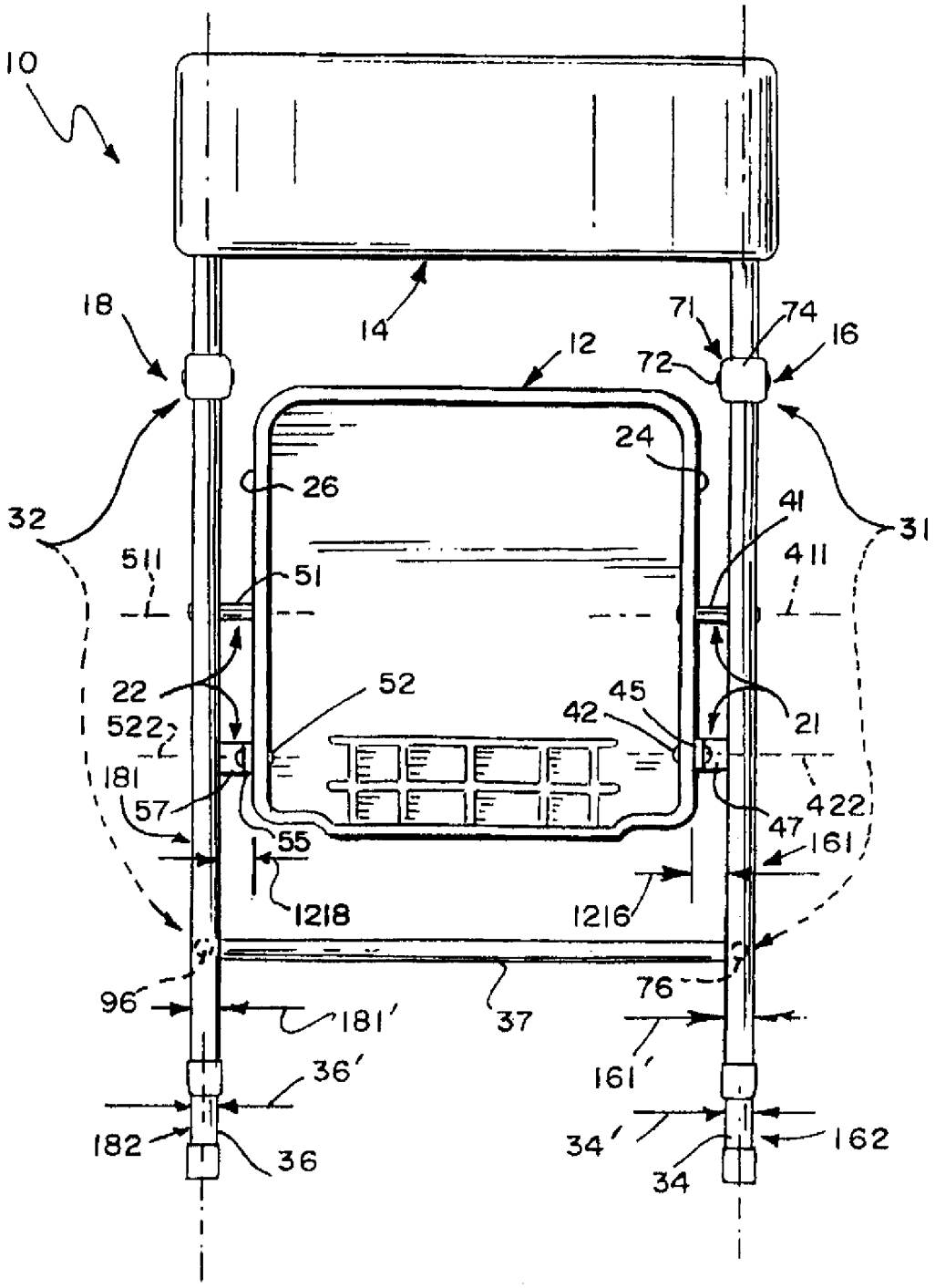

As suggested in FIGS. 2, 3, 6, and 8, an illustrative first seat support or spacing-control means 21 is provided for coupling seat 12 to right-side frame 16 so that seat 12 is supported for movement between a generally horizontal extended orientation when foldable chair 10 is "opened" to assume an expanded use position as shown in FIG. 1 and a generally vertical retracted orientation when foldable chair is "closed" to assume a collapsed, storage position as shown in FIGS. 6, 7, and 8. An illustrative second seat support or spacing-control means 22 is provided for coupling seat 12 to left-side frame 18 so that seat 12 is supported for movement from the extended orientation shown in FIG. 1 to the retracted orientation shown in FIGS. 7 and 8. First and second seat support means 21, 22 are configured to maintain at least a predetermined "seat" clearance space 1216 between seat 12 and right-side frame 16 as shown, for example, in FIG. 3 and at least a predetermined seat clearance space 1218 between seat 12 and left-side frame 18 as shown, for example, in FIG. 3.

As suggested in FIGS. 1, 6, and 8, an illustrative first rear leg support or leg mechanism or linking means 31 is associated with right-side frame 16 and provided for coupling rear leg 162 to companion front leg 161 to control movement and separation of rear leg 162 relative to front leg 162 during folding and unfolding of foldable chair 10. First rear leg linking means 31 is configured to maintain at least a predetermined "leg" clearance space 160 between front and rear legs 161, 162 of right-side frame 16 upon movement of foldable chair 10 to assume a collapsed, storage position as shown, for example, in FIG. 6.

As suggested in FIGS. 1, 7, and 8, an illustrative second rear leg support or leg mechanism or linking means 32 is associated with left-side frame 18 and provided for coupling rear leg 182 to companion front leg 181 to control movement and separation of rear leg 182 relative to front leg 181 during folding and unfolding of foldable chair 10. Second rear leg linking means 32 is configured to maintain at least a predetermined leg clearance space 180 between front and rear legs 181, 182 of left-side frame 18 upon movement of foldable chair 10 to assume the collapsed, storage position as shown, for example, in FIG. 7.

Front leg 161 of right-side frame 16 is coupled to seat back 14 and arranged to extend alongside seat 12 in spaced-apart confronting relation to a right side wall 24 included in seat 12 as suggested in FIGS. 1 and 2. Front leg 161 is separated from seat 12 by seat clearance space 1216 in the expanded, use position, as shown, for example, in FIG. 3 and in the collapsed, storage position a shown, for example, in FIG. 8.

In the illustrated embodiment, rear leg 162 of right-side frame 16 is an "extensible" leg that includes an upper rod 33 telescopically received for "up-and-down" movement in a rod-receiver channel 134 formed in a lower sleeve 34 as suggested in FIGS. 1, 3, and 4-6. Upper rod 33 is constrained to move relative to companion lower sleeve 34 from a "retracted" position shown in FIG. 1 establishing a "short" length $L_1$ of rear leg 162 to an "extended" position shown in FIG. 6 establishing a relatively longer length $L_4$ of rear leg 162. Front leg 161 has an outer diameter 161' that is less than leg clearance space 160 and lower sleeve 34 of rear leg 162 has an outer diameter 34' that is also less than leg clearance space 160. Rear leg 162 is separated from seat 12 by seat clearance space 1216 in the expanded, use position as shown, for example, in FIG. 3 and in the collapsed, storage position as shown, for example, in FIG. 8.

Likewise, as suggested in FIGS. 1 and 2, front leg 181 of left-side frame 18 is coupled to seat back 14 and arranged to extend in spaced-apart confronting relation to a left-side wall 26 included in seat 12. Front leg 181 is separated from seat 12 by seat clearance space 1218 in the expanded, use position as shown, for example, in FIG. 3 and in the collapsed, storage position as shown, for example, in FIG. 8.

In the illustrated embodiment, rear leg 182 of left-side frame 18 includes an upper rod 35 telescopically received for up-and-down movement in a rod-receiver channel 136 formed in a lower sleeve 36 as suggested in FIGS. 1 and 8. Upper rod 35 is constrained to move relative to companion lower sleeve 36 from a retracted position shown in FIG. 1 wherein rear leg 182 is characterized by "short" length $L_1$ to an extended position shown in FIG. 7 wherein rear leg 182 is characterized by relatively longer length $L_4$. Front leg 181 has an outer diameter 181' that is less than leg clearance space 180 and lower sleeve 36 of rear leg 182 has an outer diameter 36' that is also less than leg clearance space 180 as shown, for example, in FIG. 7. In an illustrative embodiment, leg clearance space 160 is about equal to leg clearance space 180. Rear leg 182 is separated from seat 12 by seat clearance space 1218 in the expanded, use position as shown, for example, in FIG. 3 and in the collapsed, storage position as shown, for example, in FIG. 8.

Figure 3:
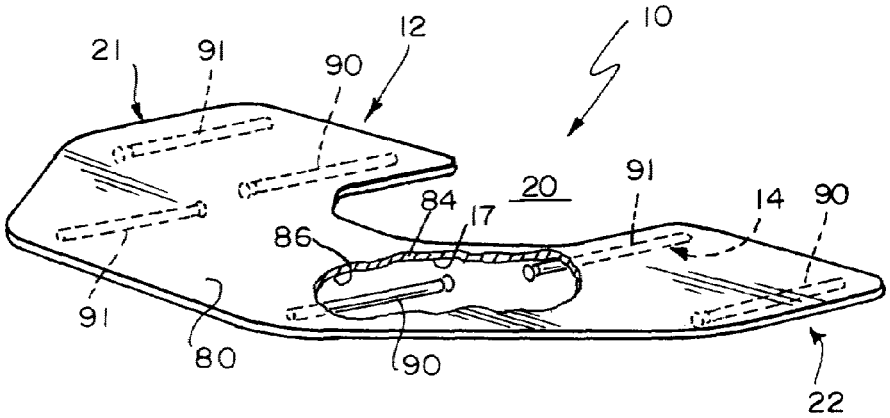
FIG. 3 is a sectional view taken along line 3-3 of FIG. 1, showing "seat" clearance space provided between the seat and the right-side frame and also between the seat and the left-side frame when the foldable chair is unfolded to assume an expanded use position.

A stretcher 37 is arranged to interconnect lower sleeve 34 of rear leg 162 and lower sleeve 36 of extensible rear leg 182 as shown, for example, in FIG. 3. Illustrative rod-receiver channels 134 and 136 are also shown in FIG. 3. A top surface 28 included in seat 12 and arranged to interconnect right and left side walls 24, 26 of seat 12 is also shown in FIG. 3.

First seat support mechanism or spacing-control means 21 illustratively includes a first pivot axle 41 associated with front leg 161 and also includes a second pivot axle 42, a mounting bracket 43, and a fastener 44, associated with rear leg 162 as illustrated, for example, in FIGS. 2 and 3. First pivot axle 41 is coupled to right side wall 24 of seat 12 and to front leg 161 to support seat 12 for pivotable movement relative to front leg 161 about pivot axis 411. Mounting bracket 43 includes an inner plate 45 adjacent to right side wall 24 of seat 12, an outer plate 46 adjacent to lower sleeve 34 of extensible rear leg 162, and a spreader plate 47 coupled to and interconnecting inner and outer plates 45, 46 at essentially a right angle to each plate 45, 46, as suggested in FIG. 3. Second pivot axle 42 is coupled to right side wall 24 of seat 12 and to inner plate 45 of mounting bracket 43 to support seat 12 for pivotable movement relative to extensible rear leg 162 about pivot axis 422. Fastener 44 is coupled to outer plate 46 and to lower sleeve 34 to anchor outer plate 46 in a fixed, stationary position on lower sleeve 34 of extensible rear leg 162. It is within the scope of the present disclosure to use other suitable linkages to provide and maintain seat clearance 1216 during folding and unfolding of foldable chair 10.

Second seat support mechanism or spacing control means 22 illustratively includes a first pivot axle 51 associated with front leg 181 and also includes a second pivot axle 52, a mounting bracket 53, and a fastener 54 associated with rear leg 182 as illustrated, for example, in FIGS. 2 and 3. First pivot axle 51 is coupled to left side wall 26 of seat 12 and to front leg 181 to support seat 12 for pivotable movement relative to front leg 181 about pivot axis 511. Mounting bracket 53 includes an inner plate 55 adjacent to left side wall 26 of seat 12, an outer plate 56 adjacent to lower sleeve 36 of extensible rear leg 182, and a spreader plate 57 coupled to and interconnecting inner and outer plates 55, 56 at essentially a right angle to each plate 55, 56, as suggested in FIG. 3. Second pivot axle 52 is coupled to left side wall 26 of seat 12 and to inner plate 55 of mounting bracket 53 to support seat 12 for pivotable movement relative to extensible rear leg 182 about pivot axis 522. Fastener 54 is coupled to outer plate 56 and to lower sleeve 36 to anchor outer plate 56 in a fixed, stationary position on lower sleeve 36 of extensible rear leg 182. It is within the scope of the present disclosure to use other suitable linkages coupled to front and rear legs 181, 182 included in left-side frame 18 to provide and maintain seat clearance space 1218 during folding and unfolding of foldable chair 10.

Figure 4:
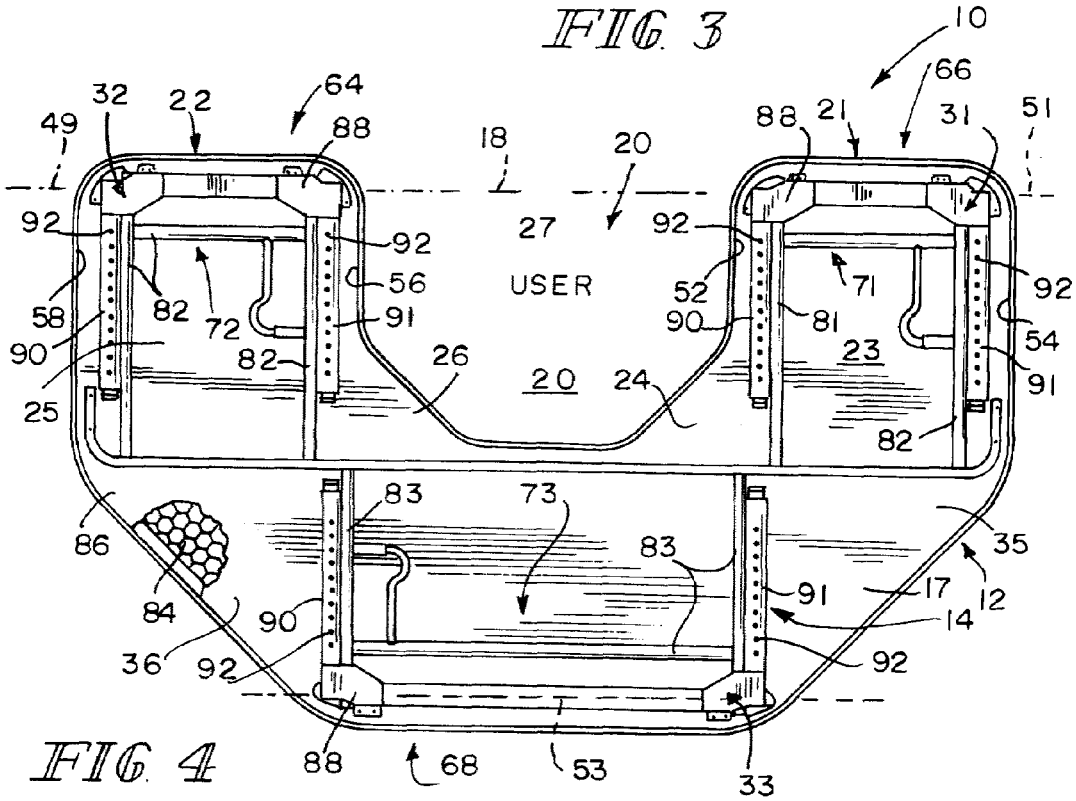
FIGS. 4-6 show a folding sequence as the foldable chair of FIGS. 1 and 2 is folded to assume a collapsed, storage position shown in FIGS. 6 and 7.

First rear leg mechanism or linking means 31 illustratively includes a support bracket 71, a fastener 72, and a pivot axle 73 as suggested in FIGS. 1 and 4. In the illustrated embodiment, support bracket 71 includes a collar 74 wrapped around front leg 161 and anchored to front leg 161 by fastener 72. Support bracket 71 also includes an extension plate 75 appended to collar 74 and extending from front leg 161. Pivot axle 73 is coupled to extension plate 75 and to an upper end of upper rod 33 to support rear leg 162 for pivotable movement relative to support bracket 71 about pivot axis 711 during folding and unfolding of foldable chair 10 as suggested in FIGS. 1 and 4-6. Extension plate 75 remains in a constant fixed position when seat 12 is moved between the extended, use position and the collapsed, storage position. A standoff 76 included in first rear leg support means 31 is appended to, for example, lower sleeve 34 of rear leg 162 and arranged to extend toward and mate with or abut companion front leg 161 to establish leg clearance space 160 upon movement of foldable chair 10 as suggested in FIGS. 1, 4, and 5 to assume a collapsed, storage position as suggested in FIG. 6. It is within the scope of the present disclosure to use other suitable linkages to provide and maintain leg clearance space 160 during folding of foldable chair 10.

Second rear leg support means 32 illustratively includes a support bracket 91, a fastener 92, and a pivot axle 93 as suggested in FIGS. 1 and 7. In the illustrated embodiment, support bracket 91 includes a collar 94 wrapped around front leg 181 and anchored to front leg 181 by fastener 92. Support bracket 91 also includes an extension plate 95 appended to collar 94. Pivot axis 93 is coupled to extension plate 95 and to an upper end of upper rod 35 to support rear leg 182 for pivotable movement relative to support bracket 71 about pivot axis 911 during folding and unfolding of foldable chair 10 as suggested in FIGS. 1 and 7. Extension plate 95 remains in a constant fixed position when seat 12 is moved between the extended, use position and the collapsed, storage position. A standoff 90 included in second rear leg support means 32 is appended, for example, to lower sleeve 36 of rear leg 182 and arranged to extend toward and mate with or abut companion front leg 181 to establish leg clearance space 180 upon movement of foldable chair 10 as suggested in FIGS. 1, 4, and 5 to assume a collapsed, storage position as suggested in FIG. 7. It is within the scope of the present disclosure to use other suitable linkages to provide and maintain leg clearance space 180 during folding of foldable chair 10.

Once foldable chair 10 is unfolded to assume the expanded, use position shown, for example, in FIGS. 1-3, seat clearance space 1216 is provided between seat 12 and right-side frame 16 and seat clearance space 1218 is provided between seat 12 and left-side frame 18. These seat clearance spaces 1216, 1218 are maintained as foldable chair is folded (in a manner shown, for example, in FIGS. 4-6) to assume a collapsed, storage position as shown, for example, in FIG. 8. The size of seat clearance spaces 1216, 1218 are a function of the lengths of pivot axles 41, 51, respectively and spreader plates 47, 57, respectively. In addition, when foldable chair 10 is in the expanded, use position and upper rod 33 of rear leg 162 is in the shortened, retracted position, a plate clearance space 1675 exists between an end 175 of extension plate 75 and an upper end 345 of sleeve 34, as shown in FIG. 1. The plate clearance space 1675 is greater than an outer diameter of legs 161, 162, 181, 182. A similar plate clearance space (not shown) to space 1675 exists between an end of extension plate 95 and an upper end of sleeve 36. This similar plate clearance space is greater than an outer diameter of legs 161, 162, 181, 182.

Figure 5:
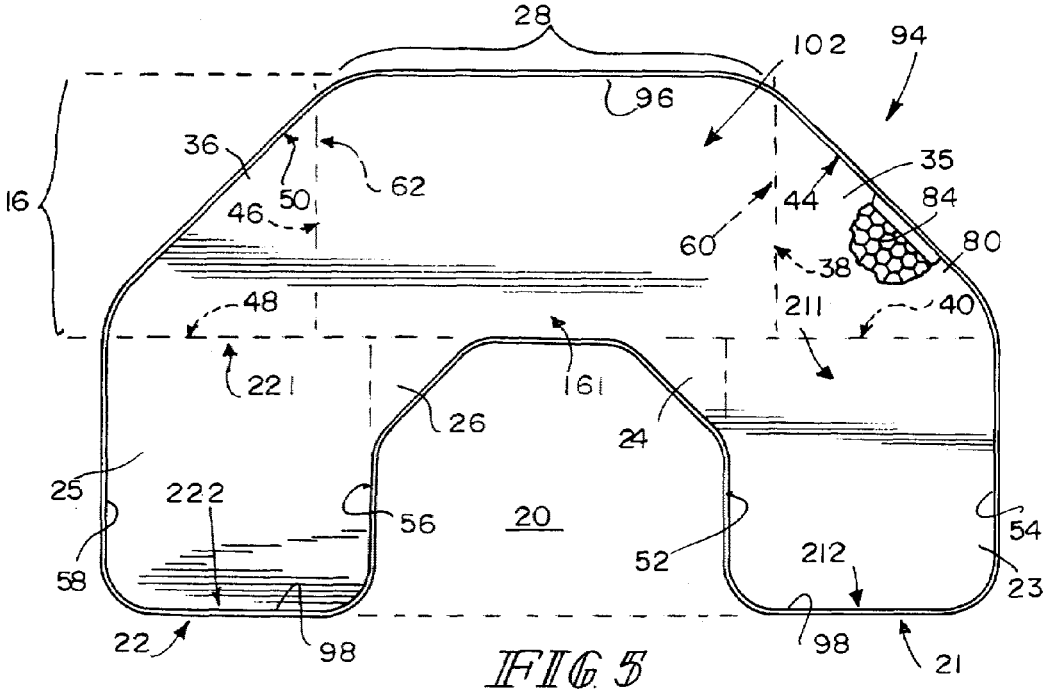

As foldable chair 10 is folded in a manner shown, for example, in FIGS. 1 and 4-6, extensible rear legs 162, 182 vary in length (owing to relative movement between upper rods 33, 35 and lower sleeves 34, 36) from a short length $L_1$ suggested in FIG. 1, to a longer length $L_2$ suggested in FIG. 4, to a still longer length $L_3$ suggested in FIG. 5, and to a longest length $L_4$ suggested in FIGS. 6 and 7. Once foldable chair 10 is folded to assume the collapsed, storage position shown, for example, in FIGS. 6 and 7, leg clearance space 160 is provided between front and rear legs 161, 162 of right-side frame 16 and leg clearance space 180 is provided between front and rear legs 181, 182 of left-side frame 18. The size of leg clearance space 160 is a function of the effective lengths of support bracket 71 and standoff 76 while the size of leg clearance space 180 is a function of the effective lengths of support bracket 91 and standoff 96.

The invention claimed is:

1. A foldable chair comprising:

a foldable right-side frame having front and rear legs configured to move between a use position wherein the legs are substantially separated from each other forming an acute angle therebetween and a storage position wherein the legs are substantially adjacent and parallel to one another, a foldable left-side frame having front and rear legs configured to move between a use position wherein the legs are substantially separated from each other forming an acute angle therebetween and a storage position wherein the legs are substantially adjacent and parallel to one another, a seat having a front end, a rear end and two sides, the seat positioned to lie between the foldable frames and being movable between an extended, use position and a collapsed, storage position, linking means for linking the front and the rear legs so as to maintain a continuously overlapping juxtaposed position between the front and rear legs, the linking means minimizing the possibility of creating a pinching action between the legs during movement of the seat between the use and collapsed positions, the linking means including a bracket having an extension plate fixedly coupled at a first end to and extending from the front leg and pivotably coupled at a second end to the rear leg, the extension plate remaining in a constant fixed position when the seat is moved between the extended, use position and the collapsed, storage position, and wherein each rear leg includes an upper portion and a lower portion configured to form a telescoping, extensible leg, the upper portion including a circular rod having a generally flat enlarged head portion extending beyond a sleeve of the lower portion having a channel to telescopically receive the rod for up-and-down movement of the rod relative to the sleeve between a retracted, short length and an extended, relatively longer length, the enlarged head portion forming a plate clearance space located between an end of the extension plate and an upper end of the sleeve, the plate clearance space being greater than an outer diameter of the legs when the foldable frames are in the extended, use position.

2. The foldable chair of claim 1, wherein the linking means further includes a standoff appended to the rear leg and arranged to extend toward and mate with the front leg when the frames are in the storage position, the bracket and standoff cooperating to establish a leg clearance space between the front and rear legs.

3. The foldable chair of claim 1, wherein the bracket includes a collar wrapped completely around the front leg and anchored to the front leg by a fastener.

4. A foldable chair comprising:

a foldable right-side frame having front and rear legs configured to move between a use position wherein the legs are substantially separated from each other forming an acute angle therebetween and a storage position wherein the legs are substantially adjacent and parallel to one another, a foldable left-side frame having front and rear legs configured to move between a use position wherein the legs are substantially separated from each other forming an acute angle therebetween and a storage position wherein the legs are substantially adjacent and parallel to one another, a seat pivotably linked to and positioned to lie between the foldable frames, the seat being movable between an extended, use position and a collapsed, storage position, a pair of leg mechanisms, each mechanism including a bracket having a collar at a first end completely wrapped around and fixedly coupled to the front leg and further having an extension plate appended to the collar and pivotably coupled at a second end of the bracket to an upper end of a respective rear leg for pivotable movement of the rear leg relative to the bracket, and each mechanism further including a standoff fixedly coupled to at least one of the front leg and respective rear leg and substantially displaced from the bracket, the leg mechanisms configured to maintain a leg clearance space between the front and rear legs of each foldable frame that is greater than an outer diameter of the legs thereby minimizing the possibility of a pinching action occurring during movement of the foldable frames from the use position to the storage position, and further including an extension plate coupled at a first end to the front leg and extending therefrom, and wherein each rear leg includes an upper portion and a lower portion configured to form a telescoping, extensible leg, the upper portion including a circular rod having a generally flat enlarged head portion extending beyond a sleeve of the lower portion having a channel to telescopically receive the rod for up-and-down movement of the rod relative to the sleeve between a retracted, short length and an extended, relatively longer length, the enlarged head portion forming a plate clearance space located between an end of the extension plate and an upper end of the sleeve, the plate clearance space being greater than an outer diameter of the legs when the foldable frames are in the extended, use position.

5. A foldable chair comprising:

a foldable right-side frame having front and rear legs configured to move between a use position wherein the legs are substantially separated from each other forming an acute angle therebetween and a storage position wherein the legs are substantially adjacent and parallel to one another, a foldable left-side frame having front and rear legs configured to move between a use position wherein the legs are substantially separated from each other forming an acute angle therebetween and a storage position wherein the legs are substantially adjacent and parallel to one another, a seat having a front end, a rear end and two sides, the seat positioned to lie between the foldable frames and being movable between an extended, use position and a collapsed, storage position, a pair of seat support mechanisms, each mechanism including a pin pivotably coupled directly to one of the front legs and directly to an adjacent side of the seat, and further including a bracket having an inner plate pivotably coupled at one end directly to the seat and having an outer plate fixedly coupled at another end directly to a respective one of the rear legs, the seat support mechanisms configured to maintain a seat clearance space between each of the legs and the seat that is greater than an outer diameter of the legs thereby minimizing the possibility of a pinching action occurring between the legs and the seat during a movement of the seat between the use and collapsed positions, and wherein, in all positions of the chair, the inner plate lies immediately adjacent and in a plane essentially parallel to a side wall of the seat, the outer plate lies immediately adjacent and in a plane essentially parallel to the rear leg, and a spreader plate interconnects the inner and outer plates and lies essentially at a right angle to each of the inner and outer plates.

6. The foldable chair of claim 5, wherein the spreader plate essentially spans an entire orthogonal distance between the inner and outer plates to define the seat clearance space and to maintain a continuous juxtaposed position between the seat and the rear leg during movement of the seat between the use and collapsed positions.

* * * * *

UNITED STATES PATENT AND TRADEMARK OFFICE

CERTIFICATE OF CORRECTION

PATENT NO. : 7,445,277 B2
APPLICATION NO. : 11/842750
DATED : November 4, 2008
INVENTOR(S) : Voris It is certified that error appears in the above-identified patent and that said Letters Patent is hereby corrected as shown below:

The Title Page Showing an Illustrative Figure, Should be Deleted and Substitute Therefor the Attach Title Page.

Delete Drawings Sheets 1-4 and Substitute Therefor the Drawing Sheets, Consisting of Figs 1-8, as Shown on the Attached Pages.

Signed and Sealed this

Twenty-fourth Day of March, 2009

John Doll

JOHN DOLL
*Acting Director of the United States Patent and Trademark Office*

(12) United States Patent
Voris

(10) Patent No.: US 7,445,277 B2
(45) Date of Patent: Nov. 4, 2008

(54) FOLDABLE CHAIR WITH EXTENSIBLE LEGS

(75) Inventor: Larry Voris, Nashville, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 11/842,750

(22) Filed: Aug. 21, 2007

(65) Prior Publication Data

US 2008/0084094 A1 Apr. 10, 2008

Related U.S. Application Data

(60) Provisional application No. 60/823,227, filed on Aug. 22, 2006.

(51) Int. Cl.
*A47C 4/20* (2006.01)

(52) U.S. Cl. ..... 297/58

(58) Field of Classification Search ..... 297/16.1, 297/58

See application file for complete search history.

(56) References Cited

U.S. PATENT DOCUMENTS

| | | | | | |
|---|---|---|---|---|---|
| 1,789,295 | A | | 1/1931 | Bauer | |
| 1,919,746 | A | * | 7/1933 | Rastetter | 297/58 |
| 2,178,195 | A | * | 10/1939 | Witman | 297/58 |
| 2,255,870 | A | * | 9/1941 | Adler | 297/58 |
| 2,270,562 | A | * | 1/1942 | Schermerhorn | 297/58 |
| 2,360,400 | A | * | 10/1944 | Clarin | 297/58 |
| 2,692,011 | A | | 10/1954 | Hickok | |
| 2,708,962 | A | | 5/1955 | Rechler | |
| 2,757,715 | A | | 8/1956 | Hendrickson | |
| 4,629,245 | A | | 12/1986 | Hardarson | |
| 4,772,068 | A | | 9/1988 | Gleckler et al. | |
| 5,577,799 | A | | 11/1996 | St. Germain | |
| 5,634,684 | A | | 6/1997 | Kojima et al. | |
| 5,707,104 | A | * | 1/1998 | Perego | 297/16.1 |
| 5,718,474 | A | | 2/1998 | Kojima et al. | |
| 6,095,597 | A | | 8/2000 | Huang | |
| 6,279,991 | B1 | | 8/2001 | Atkins et al. | |
| 6,332,646 | B1 | | 12/2001 | Tseng | |
| 6,435,607 | B1 | | 8/2002 | Liu | |
| 6,669,281 | B1 | | 12/2003 | Huang | |
| 6,871,911 | B2 | | 3/2005 | Alexander, Jr. | |
| 7,219,955 | B2 | | 5/2007 | Lu et al. | |
| 2003/0234563 | A1 | | 12/2003 | Huang | |
| 2004/0239153 | A1 | | 12/2004 | Leng | |
| 2007/0164598 | A1 | | 7/2007 | Lu et al. | |

* cited by examiner

*Primary Examiner*—Peter R. Brown
(74) *Attorney, Agent, or Firm*—Barnes & Thornburg LLP

(57) ABSTRACT

The present disclosure relates to a foldable chair having an expanded use configuration and a collapsed storage configuration. The foldable chair includes front and rear legs, a seat back coupled to the front legs, and a seat bottom mounted to pivot relative to the front and back legs.

6 Claims, 4 Drawing Sheets

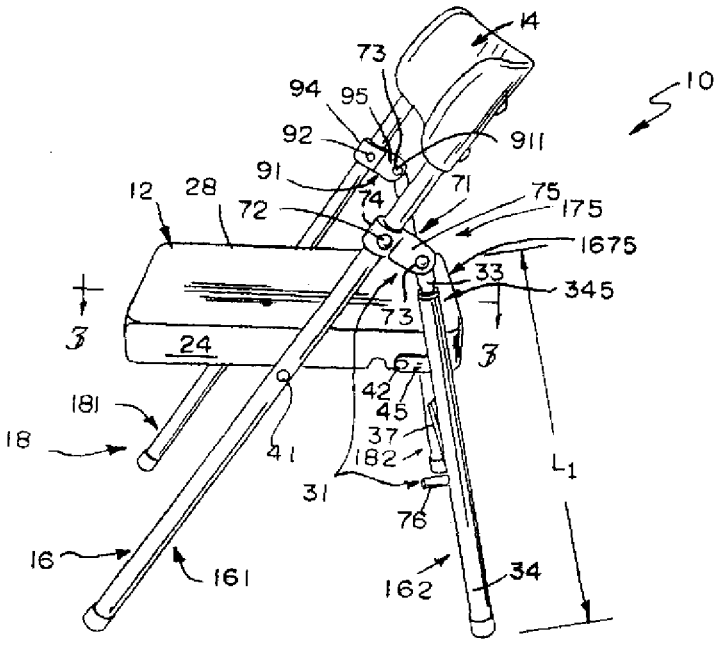

10
14
95
94
92
32
91
18
93
911
35
26
12
43
182
181
181'
180
96
36
36'
L4

10
14
L4
75
73
71
16
74
72
711
33
31
41
24
12
43
162
34
34'
161
161'
76
160

10
14
L3
73
711
71
75
16
74
72
12
33
43
42
45
34
76
162
161
24
41

10
14
L2
73
711
71
75
16
74
72
28
12
33
43
42
45
34
31
76
162
161
24
41